US010688340B1

(12) United States Patent
Aldredge

(10) Patent No.: US 10,688,340 B1
(45) Date of Patent: Jun. 23, 2020

(54) ADJUSTABLE HAND EXERCISER

(71) Applicant: Robert L. Aldredge, Englewood, OH (US)

(72) Inventor: Robert L. Aldredge, Englewood, OH (US)

( * ) Notice: Subject to any disclaimer, the term of this patent is extended or adjusted under 35 U.S.C. 154(b) by 0 days.

(21) Appl. No.: 16/729,576

(22) Filed: Dec. 30, 2019

(51) Int. Cl.

| | |
|---|---|
| ***A63B 23/16*** | (2006.01) |
| ***A63B 21/04*** | (2006.01) |
| ***A63B 21/00*** | (2006.01) |
| ***A63B 21/02*** | (2006.01) |
| ***A63B 21/045*** | (2006.01) |

(52) U.S. Cl.
CPC ..... *A63B 23/16* (2013.01); *A63B 21/00072* (2013.01); *A63B 21/025* (2013.01); *A63B 21/0421* (2013.01); *A63B 21/045* (2013.01); *A63B 21/0407* (2013.01)

(58) Field of Classification Search
CPC ... A63B 21/0421; A63B 21/02; A63B 21/025; A63B 21/00072; A63B 21/0407; A63B 21/000178; A63B 23/16; A63B 21/045–0455; A63B 21/00061; A63B 21/00043
USPC ..... 482/44–50
See application file for complete search history.

(56) References Cited

U.S. PATENT DOCUMENTS

| | | | | |
|---|---|---|---|---|
| 4,623,141 | A * | 11/1986 | Salvino | A63B 21/0455 482/127 |
| 5,060,934 | A * | 10/1991 | Winston | A63B 21/0004 482/126 |
| 8,900,105 | B2 * | 12/2014 | Zhu | A63B 21/0004 482/127 |
| 9,364,711 | B1 * | 6/2016 | Keck | A63B 23/20 |
| 9,480,876 | B1 * | 11/2016 | Blacklock | A63B 23/12 |
| 2004/0003687 | A1 * | 1/2004 | An | A63B 21/0004 81/427 |
| 2014/0038786 | A1 * | 2/2014 | Garcia | A63B 23/03508 482/49 |
| 2017/0157463 | A1 * | 6/2017 | Claesson | A63B 21/00069 |
| 2018/0200558 | A1 * | 7/2018 | Alnajjar | A63B 23/14 |

* cited by examiner

*Primary Examiner* — Loan B Jimenez
*Assistant Examiner* — Thao N Do
(74) *Attorney, Agent, or Firm* — Donald J. Ersler

(57) ABSTRACT

An adjustable hand exerciser preferably includes a torsion spring, a handle, a handle cover, an adjustment plug and a center plug. The torsion spring preferably includes at least one spring coil, a first spring leg and a second spring leg. The handle includes a first spring hole to receive the first spring leg. The handle cover includes a first pivot extension and a second pivot extension. The adjustment plug preferably includes a sliding plug and a thumb screw. An inner sliding perimeter of the handle cover is sized to receive the sliding plug. The center plug includes a plug hole. The center plug is sized to be received by an inner perimeter of the at least one spring coil. A pivot pin is retained in the first and second pivot extensions and the plug hole, such that the handle pivots relative to the handle cover.

12 Claims, 3 Drawing Sheets

ADJUSTABLE HAND EXERCISER

BACKGROUND OF THE INVENTION

1. Field of the Invention

The present invention relates generally to fitness and more specifically to an adjustable hand exerciser, which allows continuous adjustment between highest and lowest force settings.

2. Discussion of the Prior Art

U.S. Pat. No. 5,060,934 to Winston discloses a hand exerciser. Patent publication no. 2014/0038786 to Garcia discloses a grip device. Both patent documents are hereby incorporated by reference in their entirety.

Accordingly, there is a clearly felt need in the art for an adjustable hand exerciser, which allows continuous adjustment between highest and lowest force settings.

SUMMARY OF THE INVENTION

The present invention provides an adjustable hand exerciser, which allows continuous adjustment between highest and lowest force settings. The adjustable hand exerciser preferably includes a torsion spring, a handle, a handle cover, an adjustment plug and a center plug. The torsion spring preferably includes at least one spring coil, a first spring leg and a second spring leg. The first spring leg extends outward from a first end of the at least one spring coil. The second spring leg extends outward from a second end of the at least one spring coil. The handle includes an inner perimeter and an outer perimeter. The inner perimeter is sized to receive the first spring leg. The first spring leg is secured in the inner perimeter with a bonding substance, threading, swaging or any other suitable method.

The handle cover includes a curved lengthwise base, a first lengthwise leg, a second lengthwise leg, an end leg, a first pivot extension and a second pivot extension. The first lengthwise leg extends downward from one end of the curved lengthwise base. The second lengthwise leg extends downward from a second end of the curved lengthwise base. The end leg extends downward from one end of the curved lengthwise base. An oval opening is formed through the end leg. The first and second pivot extensions extend downward from a bottom of the first and second lengthwise legs at an opposing end of the curved lengthwise base. A pivot pin hole is formed through the first and second pivot extensions.

The adjustment plug preferably includes a sliding plug and a thumb screw. The sliding plug includes a cross section, which is sized to be received by an inner perimeter of a cross section of the handle cover. A spring hole is formed through the cross section of the sliding plug to slidably receive the second spring leg. The thumb screw is threaded into the sliding plug, perpendicular to the spring hole. The center plug includes an outer plug diameter and a plug hole. The outer plug diameter is sized to be received by inner perimeter of the at least one spring coil. A pivot pin is retained in the pivot pin hole of the first and second pivot extensions and the plug hole, such that the handle pivots relative to the handle cover. A force of the adjustable hand exerciser is adjusted by sliding the adjustment plug along a length of the second spring leg. The closer the adjustment plug is to the pivot pin, the greater the force required to close the adjustable hand exerciser.

Accordingly, it is an object of the present invention to provide an adjustable hand exerciser, which allows continuous adjustment between highest and lowest force settings.

These and additional objects, advantages, features and benefits of the present invention will become apparent from the following specification.

DETAILED DESCRIPTION OF THE PREFERRED EMBODIMENTS

Figure 1:
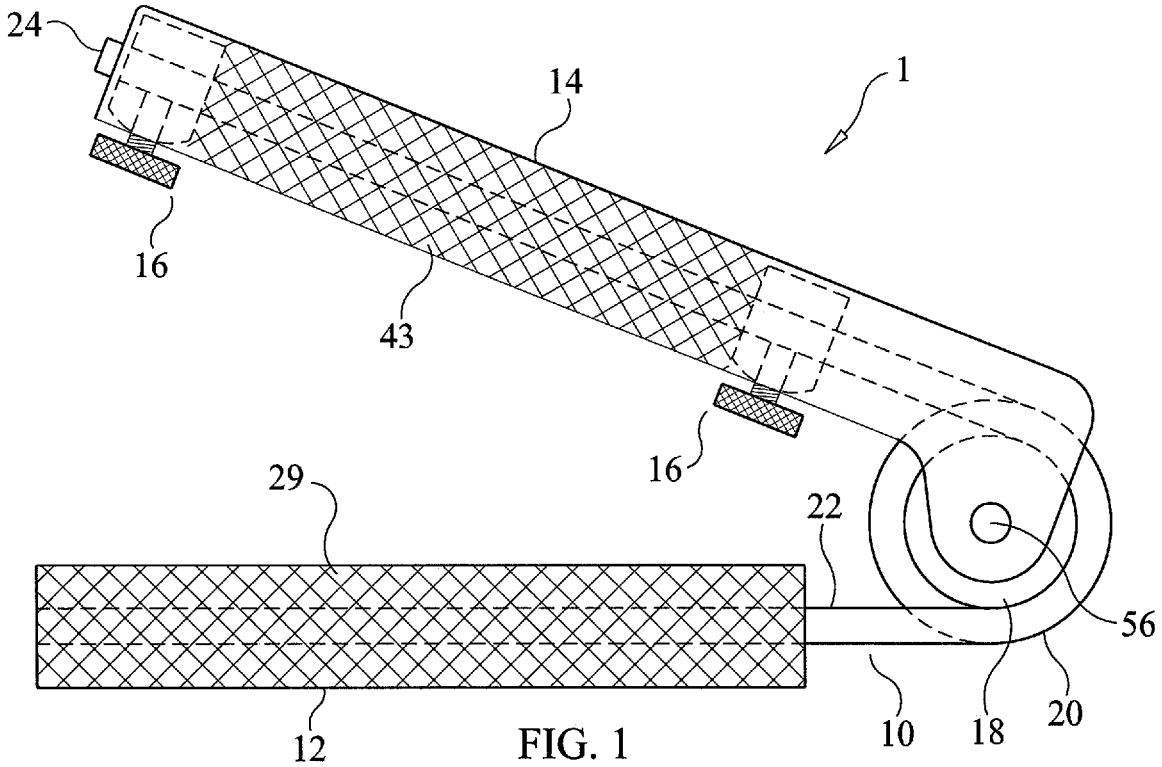
FIG. 1 is a side view of an adjustable hand exerciser with an adjustment plug in a greatest force position and in a least force position in accordance with the present invention.
Figure 2:
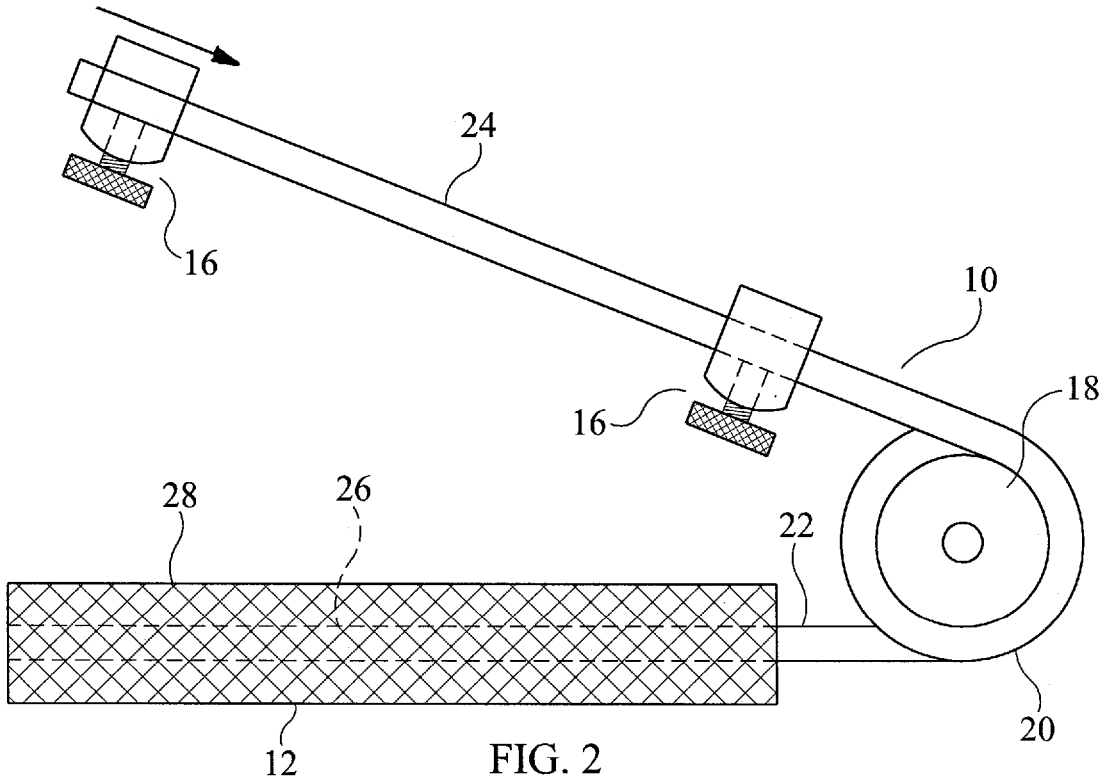
FIG. 2 is a side view of an adjustable hand exerciser with a handle cover removed and an adjustment plug in a greatest force position and in a least force position in accordance with the present invention.

With reference now to the drawings, and particularly to FIG. 1, there is shown a side view of an adjustable hand exerciser 1. With reference to FIG. 2, the adjustable hand exerciser 1 preferably includes a torsion spring 10, a handle 12, a handle cover 14, an adjustment plug 16 and a center plug 18. The torsion spring 10 preferably includes at least one spring coil 20, a first spring leg 22 and a second spring leg 24. The first spring leg 22 extends outward from a first end of the at least one spring coil 20. The spring coil 20 is a pivot end of the torsion spring 10. The second spring leg 22 extends outward from a second end of the at least one spring coil 20. The torsion spring 10 is preferably fabricated from any suitable spring steel, but other materials could also be used. The handle 12 includes a first spring hole 26 an outer perimeter 28. The first spring hole 26 is sized to receive the first spring leg 22. The first spring leg 22 is secured in the inner perimeter with a bonding substance, threading, swaging or any other suitable method, such that an entire length of the handle 12 is contact with the first spring leg 22. The outer perimeter 28 may have any suitable cross-section shape. The handle 12 preferably includes a grip surface 29.

Figure 3:
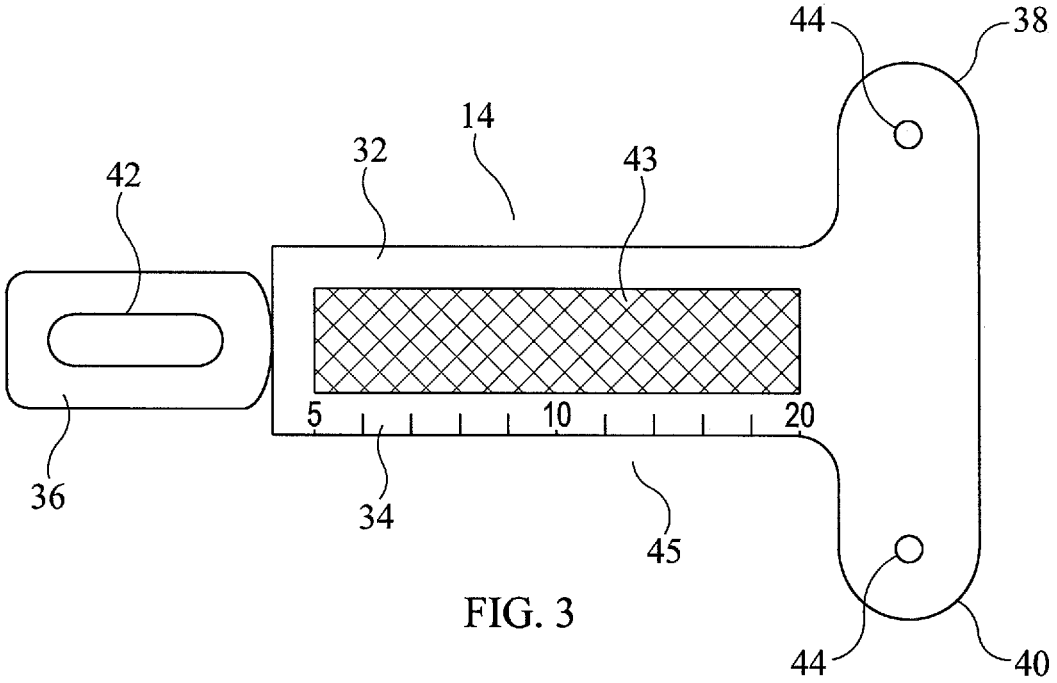
FIG. 3 is a top view of a cover handle before it is formed from a flat plate of an adjustable hand exerciser in accordance with the present invention.
Figure 4:
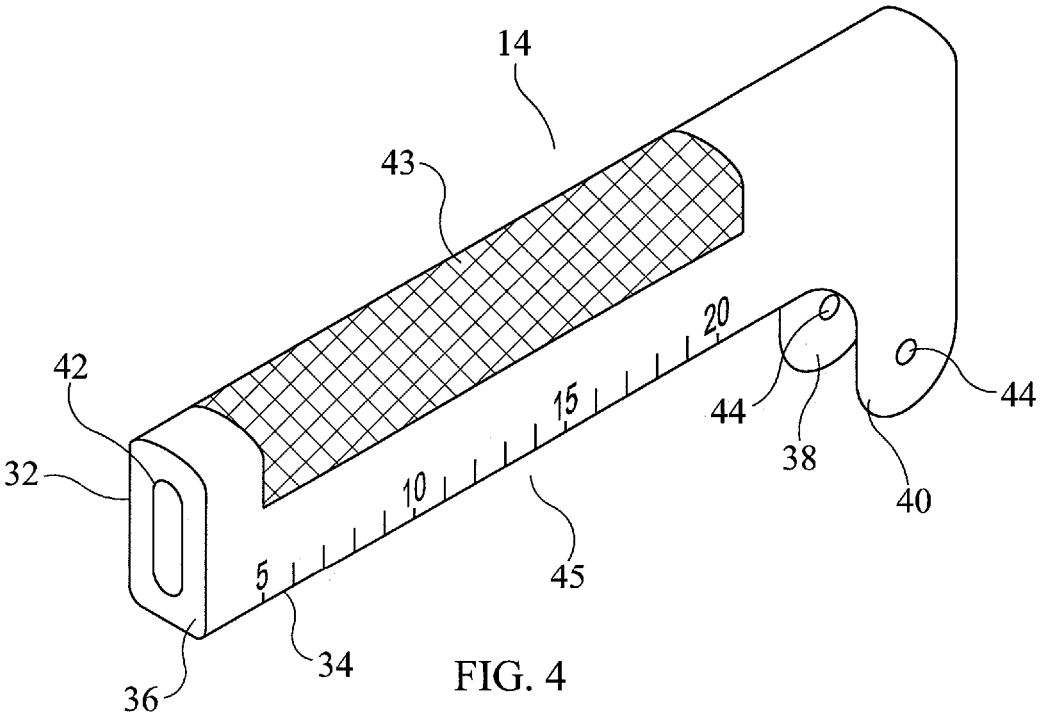
FIG. 4 is a perspective view of a cover handle of an adjustable hand exerciser in accordance with the present invention.

With reference to FIGS. 3-4, the handle cover 14 is preferably fabricated by bending a flat plate. The handle cover 14 includes a curved lengthwise base 30, a first lengthwise leg 32, a second lengthwise leg 34, an end leg 36, a first pivot extension 38 and a second pivot extension 40. The first lengthwise leg 32 extends downward from one end of the curved lengthwise base 30. The second lengthwise leg 34 extends downward from a second end of the curved lengthwise base 30. The end leg 36 extends downward from one end of the curved lengthwise base 30. An oval opening 42 is formed through the end leg 36. The first and second pivot extensions 38, 40 extend downward from a bottom of the first and second lengthwise legs 32, 34 at an opposing end of the curved lengthwise base 30. A pivot pin hole 44 is formed through the first and second pivot extensions 38, 40, which is a pivot end. An end of the second spring leg 24 preferably extends through the oval opening 42 and past the end leg 36 or the end opposite the pivot end. A grip surface 43 is preferably formed on the cover handle 14. Force indica 45 is preferably formed on a bottom of at least one of the first and second lengthwise legs 32, 34 to approximately illustrate the amount of force required to bring the handle 12 and the handle cover 14 together. The adjustable hand exerciser 1 should not be limited to the numbers shown in FIGS. 3-4, but could include any approximate force range.

Figure 5:
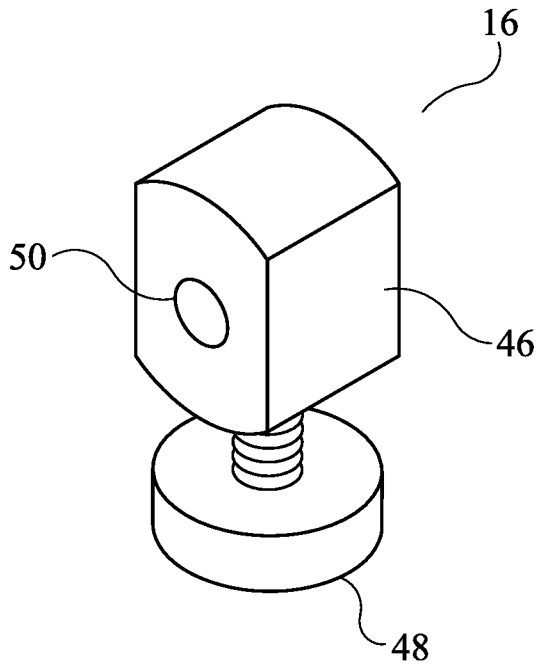
FIG. 5 is a perspective end view of an adjustment plug of an adjustable hand exerciser in accordance with the present invention.

With reference to FIG. 5, the adjustment plug 16 preferably includes a sliding plug 46 and a thumb screw 48. The sliding plug 46 includes a cross section, which is sized to be received by an inner perimeter of a cross section of the handle cover 14. A spring hole 50 is formed through the cross section of the sliding plug 46 to slidably receive the second spring leg 24. The thumb screw 48 is threaded into the sliding plug 46, preferably perpendicular to the spring hole 50 to prevent axial movement between the sliding plug 46 and the second spring leg 24. The adjustment plug 16 is adjustable along a length of the handle cover 14 to an end opposite the pivot end of the handle cover 14.

Figure 6:
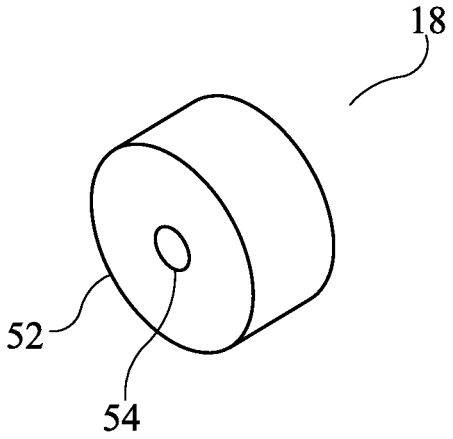
FIG. 6 is a perspective view of a center plug of an adjustable hand exerciser in accordance with the present invention.

With reference to FIG. 6, the center plug 18 includes an outer plug diameter 52 and a plug hole 54. The outer plug diameter 52 is sized to be received by an inner perimeter of the at least one spring coil 20. A pivot pin 56 is retained in the pivot pin hole 44 of the first and second pivot extensions 38, 40 and the plug hole 54, such that the handle 12 pivots relative to the handle cover 14. A force of the adjustable hand exerciser 1 is adjusted by sliding the adjustment plug 16 along a length of the second spring leg 24 and the thumb screw 48 is then tightened, adjacent the appropriate force indica 45. The closer the adjustment plug 16 is to the pivot pin 54, the greater the force required to close the adjustable hand exerciser 1. An inside surface of the handle cover 14 contacts the sliding plug 46, when the handle 12 and the handle cover 14 are squeezed together.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. An adjustable hand exerciser comprising:

a torsion spring includes at least one spring coil, a first spring leg and a second spring leg;

a handle having a handle opening which is sized to receive said first spring leg;

a handle cover having a first pivot extension and a second pivot extension, said first and second pivot extensions are pivotally engaged with said at least one spring coil at a pivot end; and an adjustment plug includes a sliding plug and a thumb screw, a plug opening is formed through said sliding plug to receive said second spring leg, said thumb screw is threaded into said sliding plug to engage said second spring leg, said adjustment plug is adjustable along a length of said handle cover to an end opposite said pivot end of said handle cover, wherein a location of said adjustment plug along a length of said second spring leg changes a force required to bring said handle and said handle cover together.

2. The adjustable hand exerciser of claim 1 wherein:

said handle cover includes a curved lengthwise base, a first lengthwise leg and a second lengthwise leg, said first lengthwise leg extends downward from one end of said curved lengthwise base, said second lengthwise leg extends downward from a second end of said curved lengthwise base, said first and second pivot extensions extend downward from a bottom of the first and second lengthwise legs at one end of said curved lengthwise base.

3. The adjustable hand exerciser of claim 1, further comprising:

a pivot pin is retained in said at least one spring coil and in said first and second pivot extensions.

4. The adjustable hand exerciser of claim 2 wherein:

a force indicia is formed on at least one of said first and second lengthwise legs.

5. An adjustable hand exerciser comprising:

a torsion spring includes at least one spring coil, a first spring leg and a second spring leg;

a handle having a handle opening which is sized to receive said first spring leg, an entire length of said handle is in contact with said first spring leg;

a handle cover having a first pivot extension, a second pivot extension and a lengthwise inner perimeter, said first and second pivot extensions are pivotally engaged with said at least one spring coil; and an adjustment plug includes a sliding plug and a thumb screw, a plug opening is formed through said sliding plug to receive said second spring leg, said thumb screw is threaded into said sliding plug to engage said second spring leg, wherein a location of said adjustment plug along a length of said second spring leg changes a force required to bring said handle and said handle cover together.

6. The adjustable hand exerciser of claim 5 wherein:

said handle cover includes a curved lengthwise base, a first lengthwise leg and a second lengthwise leg, said first lengthwise leg extends downward from one end of said curved lengthwise base, said second lengthwise leg extends downward from a second end of said curved lengthwise base, said first and second pivot extensions extend downward from a bottom of the first and second lengthwise legs at one end of said curved lengthwise base.

7. The adjustable hand exerciser of claim 5 wherein:

a pivot pin is retained in said at least one spring coil and in said first and second pivot extensions.

8. The adjustable hand exerciser of claim 6 wherein:

a force indicia is formed on at least one of said first and second lengthwise legs.

9. An adjustable hand exerciser comprising:

a torsion spring includes at least one spring coil, a first spring leg and a second spring leg;

a handle having a handle opening which is sized to receive said first spring leg;

a handle cover having a first pivot extension, and a second pivot extension, said first and second pivot extensions are pivotally engaged with said at least one spring coil at a pivot end of said torsion spring, said second spring leg has an end opposite of said pivot end of said torsion spring that extends past an end opposite of said pivot end of said handle cover; and an adjustment plug includes a sliding plug and a thumb screw, a plug opening is formed through said sliding plug to receive said second spring leg, said thumb screw is threaded into said sliding plug to engage said second spring leg, wherein a location of said adjustment plug along a length of said second spring leg changes a force required to bring said handle and said handle cover together.

10. The adjustable hand exerciser of claim 9 wherein:

said handle cover includes a curved lengthwise base, a first lengthwise leg and a second lengthwise leg, said first lengthwise leg extends downward from one end of said curved lengthwise base, said second lengthwise leg extends downward from a second end of said curved lengthwise base, said first and second pivot extensions extend downward from a bottom of the first and second lengthwise legs at one end of said curved lengthwise base.

11. The adjustable hand exerciser of claim 9 wherein:

a pivot pin is retained in said center plug in said first and second pivot extensions.

12. The adjustable hand exerciser of claim 10 wherein:

a force indicia is formed on at least one of said first and second lengthwise legs.

* * * * *